US009638379B2

(12) United States Patent
Sun

(10) Patent No.: US 9,638,379 B2
(45) Date of Patent: May 2, 2017

(54) WORK LAMP WITH MAGNETIC TRAY AND TOOLS

(71) Applicant: Shanghai Easy-Use Tools Enterprise Co., Ltd., Shanghai (CN)

(72) Inventor: Shiyu Sun, Shanghai (CN)

(73) Assignee: SHANGHAI EASY—USE TOOLS ENTERPRISE CO., LTD., Shanghai (CN)

( * ) Notice: Subject to any disclaimer, the term of this patent is extended or adjusted under 35 U.S.C. 154(b) by 175 days.

(21) Appl. No.: 14/644,665

(22) Filed: Mar. 11, 2015

(65) Prior Publication Data

US 2016/0265754 A1 Sep. 15, 2016

(51) Int. Cl.

| | |
|---|---|
| ***F21V 33/00*** | (2006.01) |
| ***F21L 4/00*** | (2006.01) |
| ***F21L 4/04*** | (2006.01) |
| ***F21V 21/08*** | (2006.01) |
| ***F21V 21/096*** | (2006.01) |
| *F21V 15/01* | (2006.01) |
| *F21Y 115/10* | (2016.01) |

(52) U.S. Cl.

CPC ..... *F21L 4/04* (2013.01); *F21V 21/08* (2013.01); *F21V 21/0965* (2013.01); *F21V 15/01* (2013.01); *F21V 33/0084* (2013.01); *F21Y 2115/10* (2016.08)

(58) Field of Classification Search

CPC ..... F21L 4/04; F21L 4/045; F21L 7/00; F21L 4/005; F21V 21/08; F21V 21/0965; F21V 15/01; F21V 33/0084; B25B 11/002

See application file for complete search history.

(56) References Cited

U.S. PATENT DOCUMENTS

| | | | | |
|---|---|---|---|---|
| 3,231,730 A | 1/1966 | Wagner | | |
| 4,364,104 A | 12/1982 | Holahan et al. | | |
| 5,915,825 A * | 6/1999 | Weister | A61B 1/267 | 362/138 |
| 6,193,386 B1 * | 2/2001 | Reynolds | F21V 14/045 | 362/109 |
| 6,457,841 B1 * | 10/2002 | Lynch | F21L 4/045 | 362/197 |

(Continued)

FOREIGN PATENT DOCUMENTS

| | | |
|---|---|---|
| CN | 201202980 Y | 3/2009 |
| CN | 201892036 U | 7/2011 |

(Continued)

*Primary Examiner* — Renee Chavez
*Assistant Examiner* — Erin Kryukova
(74) *Attorney, Agent, or Firm* — Coats & Bennett, PLLC

(57) ABSTRACT

A lighting device provides a storage tray or cavity. The lighting device includes a head section pivotally connected to a base section via a connection assembly. The head section includes a light source, and the base section includes a storage cavity with a magnetic floor. The connection assembly allows the head section to be variably positioned relative to the base section by pivoting simultaneously about mutually orthogonal axes, one of which is fixed relative to the base section, and the other of which is movable relative to the base section. The lighting device may optionally include removable tools, such as a telescopic pick-up tool, and/or various means for attaching the lighting device to a support.

13 Claims, 9 Drawing Sheets

(56) References Cited

U.S. PATENT DOCUMENTS

| | | | | |
|---|---|---|---|---|
| 6,698,906 | B1 * | 3/2004 | Tally | B25B 9/00 359/864 |
| D563,014 | S | 2/2008 | Levine | |
| 7,591,572 | B1 | 9/2009 | Levine | |
| 7,648,261 | B2 | 1/2010 | Ko et al. | |
| 7,731,386 | B2 | 6/2010 | Levine | |
| 8,348,483 | B2 | 1/2013 | Lin | |
| 2006/0087833 | A1 * | 4/2006 | Simoni | A01K 27/006 362/103 |
| 2007/0103917 | A1 * | 5/2007 | Wu | F21V 21/0965 362/398 |
| 2007/0291478 | A1 * | 12/2007 | Petzl | F21L 4/027 362/205 |
| 2008/0174991 | A1 * | 7/2008 | Tucker | F21L 4/027 362/200 |
| 2009/0290335 | A1 * | 11/2009 | Levine | F21V 17/007 362/220 |
| 2012/0033415 | A1 * | 2/2012 | Sharrah | F21L 4/027 362/199 |
| 2012/0281421 | A1 * | 11/2012 | Lin | F21L 4/045 362/427 |
| 2013/0128597 | A1 | 5/2013 | Chang | |
| 2013/0329412 | A1 * | 12/2013 | Ko | F21L 4/045 362/191 |
| 2014/0328054 | A1 * | 11/2014 | Andersen | F21L 4/00 362/202 |
| 2015/0116993 | A1 * | 4/2015 | Luo | F21L 4/005 362/186 |
| 2015/0131276 | A1 * | 5/2015 | Thompson | F21L 4/025 362/191 |

FOREIGN PATENT DOCUMENTS

| | | | |
|---|---|---|---|
| CN | 202361305 | U | 8/2012 |
| CN | 202825622 | U | 3/2013 |
| CN | 203167463 | U | 8/2013 |
| GB | 2432654 | A | 5/2007 |
| TW | 201248063 | A1 | 12/2012 |
| WO | 2016026281 | A1 | 2/2016 |

* cited by examiner

WORK LAMP WITH MAGNETIC TRAY AND TOOLS

BACKGROUND

This application is related to lighting devices, and particularly to lighting devices that also provide a storage tray.

Hand-held flashlights provide illumination for a wide variety of uses. However, conventional flashlights do not typically include any convenient means for storing small parts, such as screws, nuts, washers, O-rings, clips, brackets, and the like. Further, conventional flashlights are typically not self-supporting in a variety of positions so as to be able to stably direct light in a variety of selected directions as needed. As such, there remains a need for alternative lighting device designs, particularly lighting devices that provide a convenient means of holding small parts while being suitable for use in a variety of situations.

SUMMARY

The present invention provides a lighting device with a storage tray or cavity. In one or more embodiments, the lighting device includes a head section pivotally connected to a base section via a connection assembly. The head section includes a light source, and the base section includes a storage cavity with a magnetic floor. The connection assembly allows the head section to be variably positioned relative to the base section by pivoting simultaneously about mutually orthogonal axes, one of which is fixed relative to the base section, and the other of which is movable relative to the base section. For some embodiments, the lighting device optionally includes removable tools, such as a telescopic pick-up tool, and/or various means for attaching the lighting device to a support.

In one or more embodiments, the invention more particularly provides a lighting device comprising a head section, a base section, and a connection assembly. The head section is pivotally connected to the base section via the connection assembly. The base section has a longitudinal axis and comprises a storage cavity having a floor, wherein the floor is magnetic, and an upper surface defining a perimeter about the storage cavity. The head section comprises a base frame, a cover attached to the base frame, and a light source disposed so as to selectively emit light beyond the cover in an emission direction E oriented from the base frame toward the cover. The connection assembly comprises a pivoting body pivotably mounted to the base section and pivotably mounted to the head section. The connection assembly is configured to allow the head section to simultaneously pivot relative to the base section both: a) about a fixed first axis disposed transverse to the longitudinal axis of the base section; and b) about a movable second axis that remains disposed orthogonal to the first axis. The lighting device is movable between a first closed configuration, a first open configuration, and a second open configuration. In the first closed configuration: a) an angle $\alpha$ between the second axis and the longitudinal axis of the base section is a first amount; b) a first theoretical plane normal to direction E is parallel to the first axis; and c) the entire perimeter of the storage cavity is overlapped by the head section so as to enclose the storage cavity. In the first open configuration: a) the angle $\alpha$ is a second amount more than the first amount; b) the first theoretical plane is parallel to the first axis; and c) the entire perimeter of the storage cavity is not overlapped by the head section so that the storage cavity is at least partially open. In the second open configuration: a) the angle $\alpha$ is a third amount larger than the second amount; b) the first theoretical plane is transverse to the first axis; and c) the entire perimeter of the storage cavity is not overlapped by the head section so that the storage cavity is at least partially open.

In some embodiments, the head section is rotatable 360° about the second axis. In some embodiments, the angle $\alpha$ may vary between about 0° and about 180°. In some embodiments, the base section further comprises a selectively deployable hook. In some embodiments, the lighting device further comprises a telescoping shaft removably mounted to the base section; the telescoping shaft having a magnetic tip. The base section may comprise a recess disposed in spaced relation to the storage cavity and generally parallel to the longitudinal axis of the base section, wherein the recess is configured to receive the telescoping shaft. In some embodiments, the lighting device further comprises a mirror assembly removably mounted to the head section. The mirror may be configured to be removably mated to the telescoping shaft via the magnetic tip. In some embodiments, the mirror assembly is removably mated to the telescoping shaft via a male/female connection that includes the magnetic tip, with the mirror assembly forming being a male portion of the male/female connection. In some embodiments, the head section comprises a movable switch operative to control an on/off state of the light source; wherein the movable switch is disposed on a lateral side of the head section. In some embodiments, the connection assembly includes a plurality of detents configured to hold the head section in a plurality of positions relative to the base section. In some embodiments, the light source comprises a Chip On Board Light Emitting Diode (COB LED) assembly.

The various aspects discussed above may be used alone or in any combination. The various apparatus disclosed herein may operate according to any combination of various methods disclosed herein, and vice versa. Further, the present invention is not limited to the above features and advantages. Indeed, those skilled in the art will recognize additional features and advantages upon reading the following detailed description, and upon viewing the accompanying drawings.

DETAILED DESCRIPTION

Figure 1:
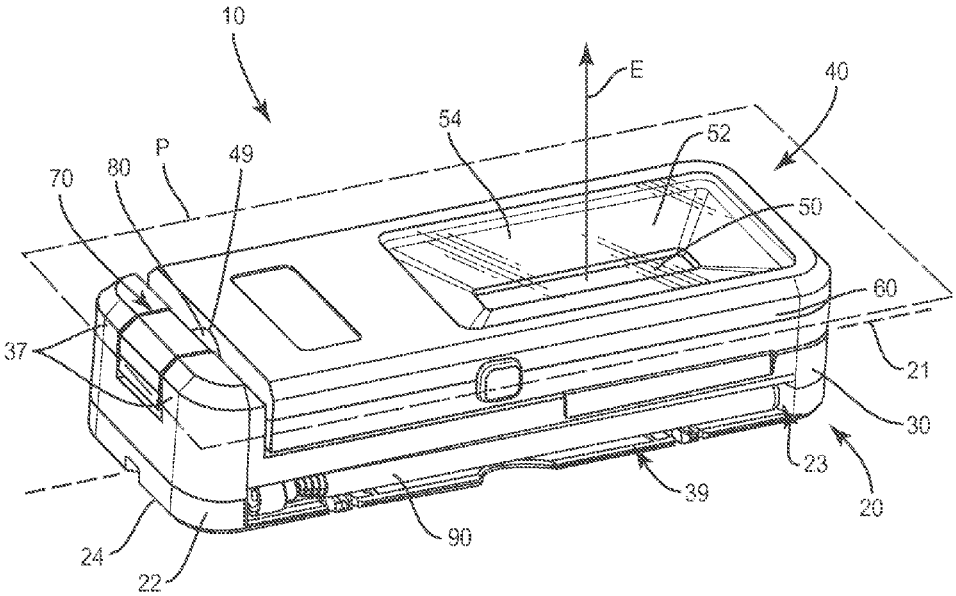
FIG. 1 shows a perspective view of a lighting device according to one or more embodiments, in a closed configuration.
Figure 2:
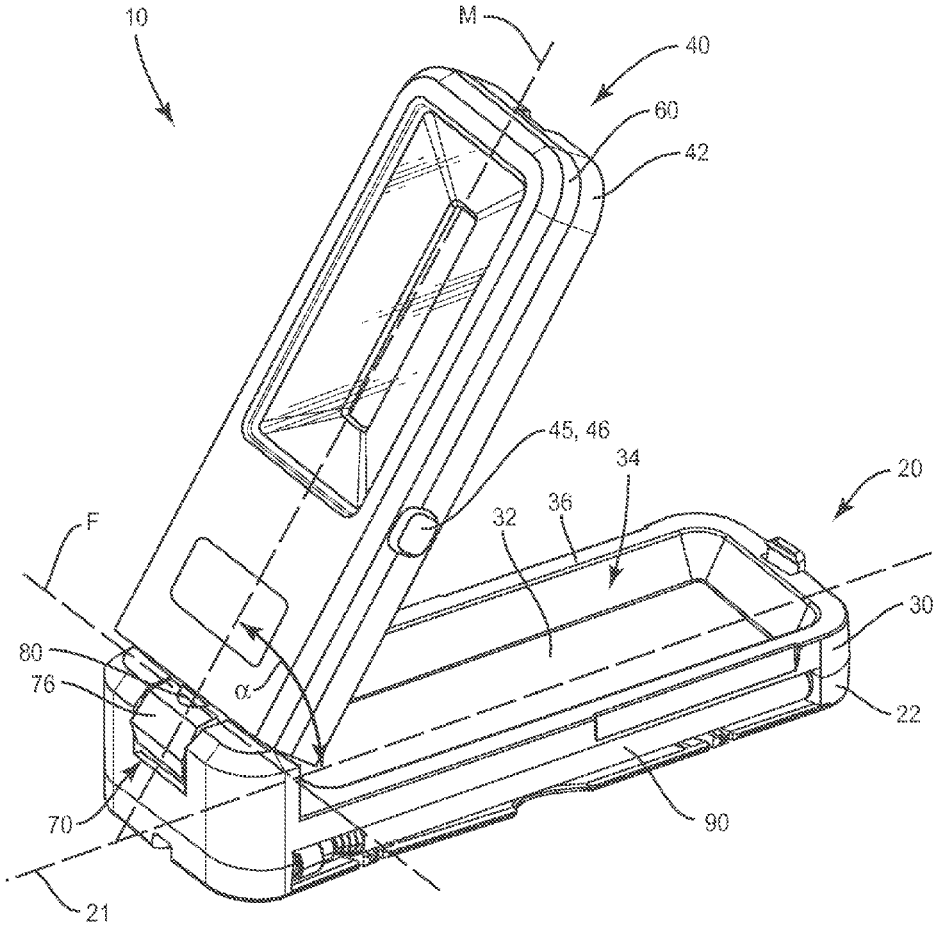
FIG. 2 shows the lighting device of FIG. 1, in an open configuration, with the storage cavity partially overlapped by the head section.
Figure 3:
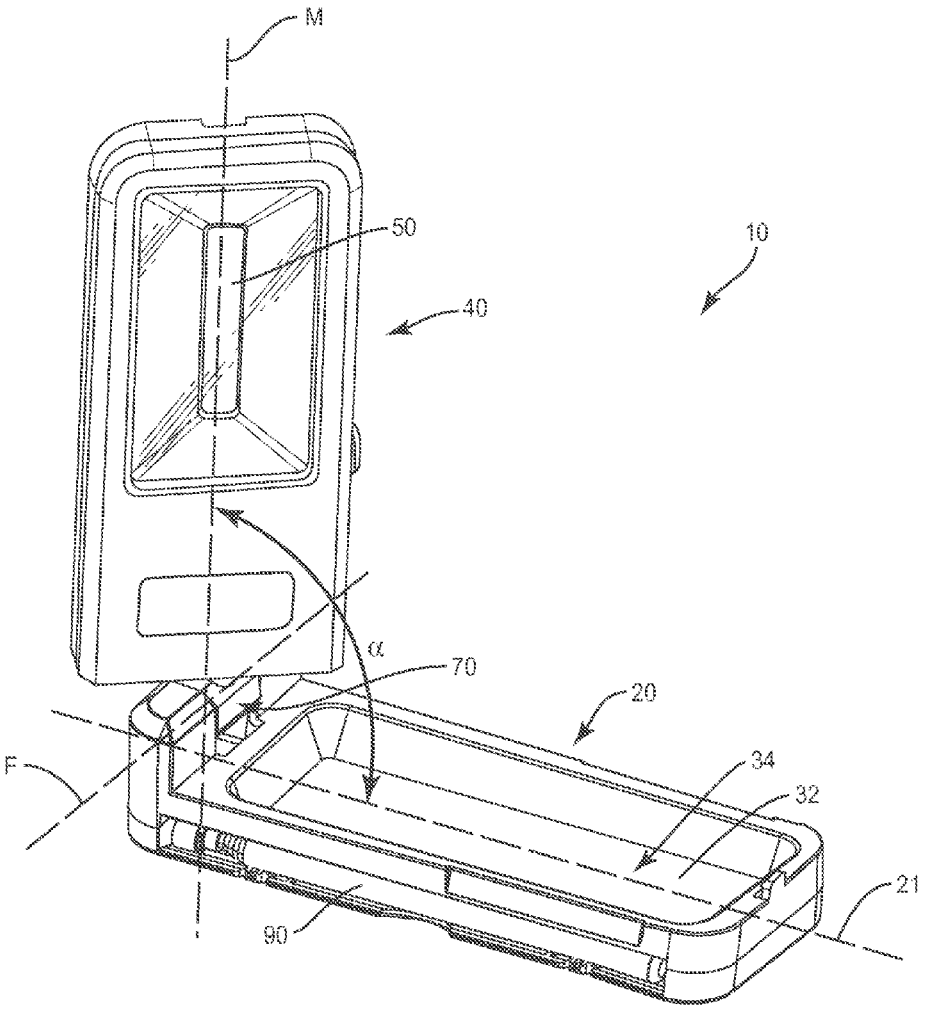
FIG. 3 shows the lighting device of FIG. 1, in another open configuration.
Figure 4:
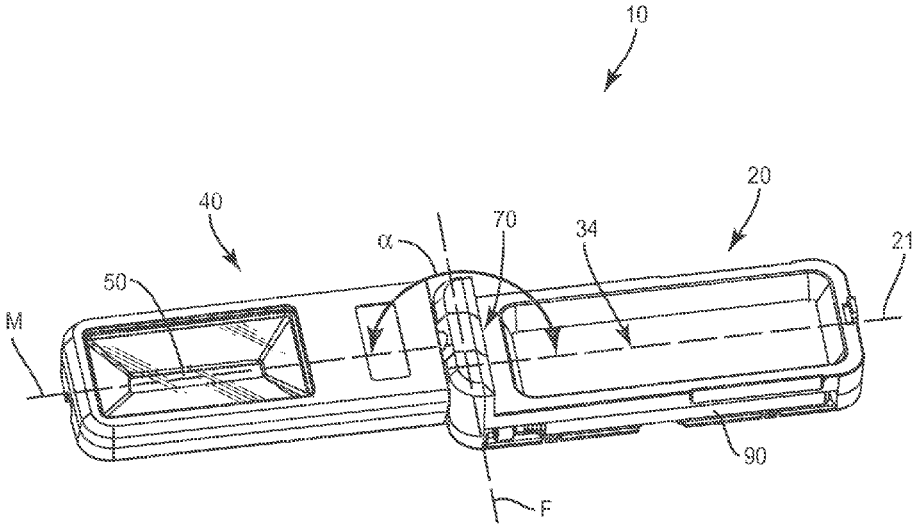
FIG. 4 shows the lighting device of FIG. 1, in yet another open configuration, with the storage cavity fully open and non-overlapped by the head section.

The present application is directed to a lighting device that provides a storage tray or cavity. In one or more embodiments, the lighting device includes a head section pivotally connected to a base section via a connection assembly. The head section includes a light source, and the base section includes a storage cavity with a magnetic floor. The connection assembly allows the head section to be variably positioned relative to the base section by pivoting simultaneously about mutually orthogonal axes, one of which is fixed relative to the base section, and the other of which is movable relative to the base section. For some embodiments, the lighting device optionally includes removable tools, such as a telescopic pick-up tool, and/or various means for attaching the lighting device to a support.

Referring to FIGS. 1-7, a lighting device is shown, generally indicated at 10. The lighting device 10 includes a base section 20, a head section 40, and a pivot mechanism 70 that movably connects the head section 40 to the base section 20. The base section 20 includes a main frame 22, a bezel 30, and a floor piece 32 (or simply floor). The main frame 22 is advantageously generally rectilinear, with suitable internal reinforcing ribs and the like. The main frame 22 may include suitable external recesses. For example, the underside surface 24 of the main frame 22 advantageously includes a suitable recess 25 for receiving a hook 38, as discussed further below. In addition, a magnet 26, optionally coupled with a metallic shroud 27, may be mounted to another recess in the underside surface 24 of the main frame 22. The lateral side of the main frame 22 may include all or part of a long channel or recess 39 that extends parallel to the base section's longitudinal axis 21 for receiving a pick-up tool 90, as discussed further below. The bezel 30 mounts to the upper portion of the main frame 22. The floor piece 32 is captured between the bezel 30 and the main frame 22. The floor piece 32 and the bezel 30 jointly form an upwardly open storage cavity 34, with the perimeter 36 of the storage cavity defined by the bezel 30. The floor piece 32 is advantageously generally planar, and is magnetic. Advantageously, the floor piece 32 is formed of a plastic or rubber coated magnetic element. The end portion of the base section 20 closest to the head section 40 includes one or more bosses 37, formed in the bezel 30 in the illustrated embodiment, for engaging with a portion of the pivot mechanism 70.

Figure 5:
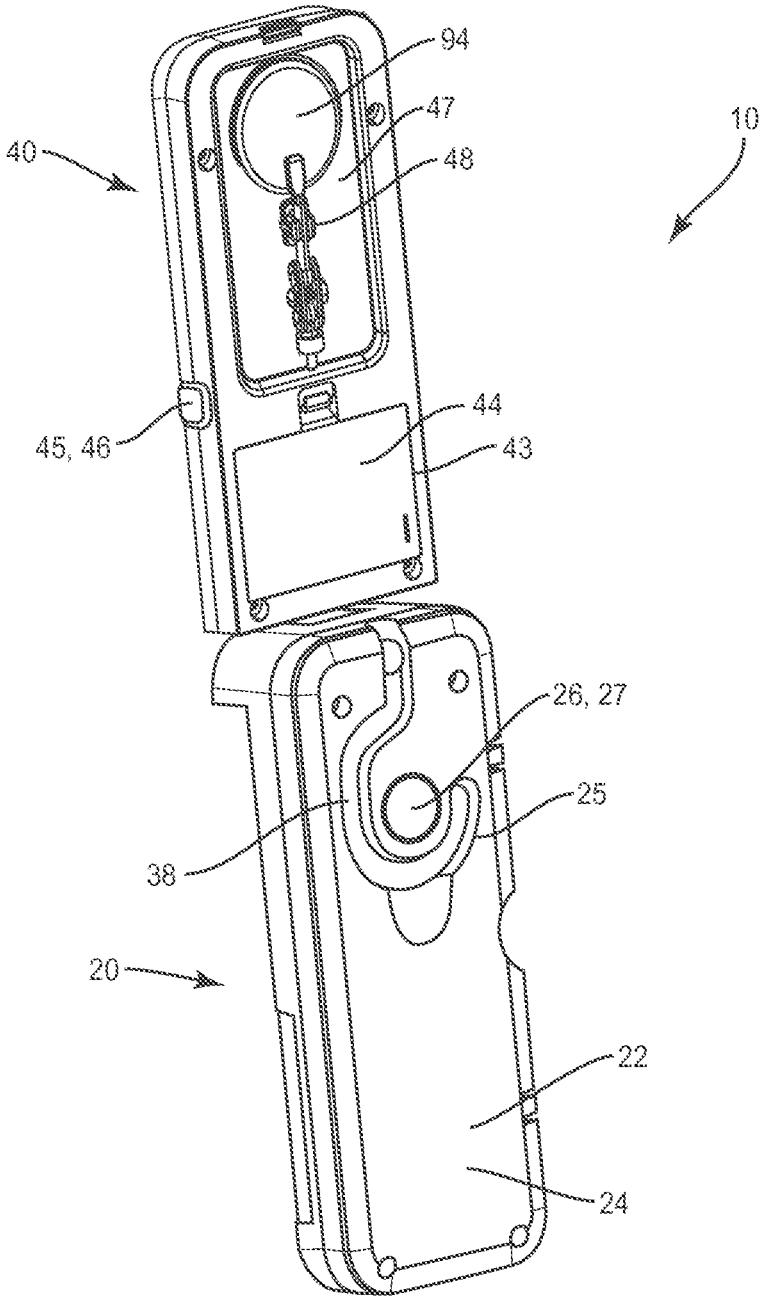
FIG. 5 shows an opposing view of the lighting device of FIG. 4.
Figure 6:
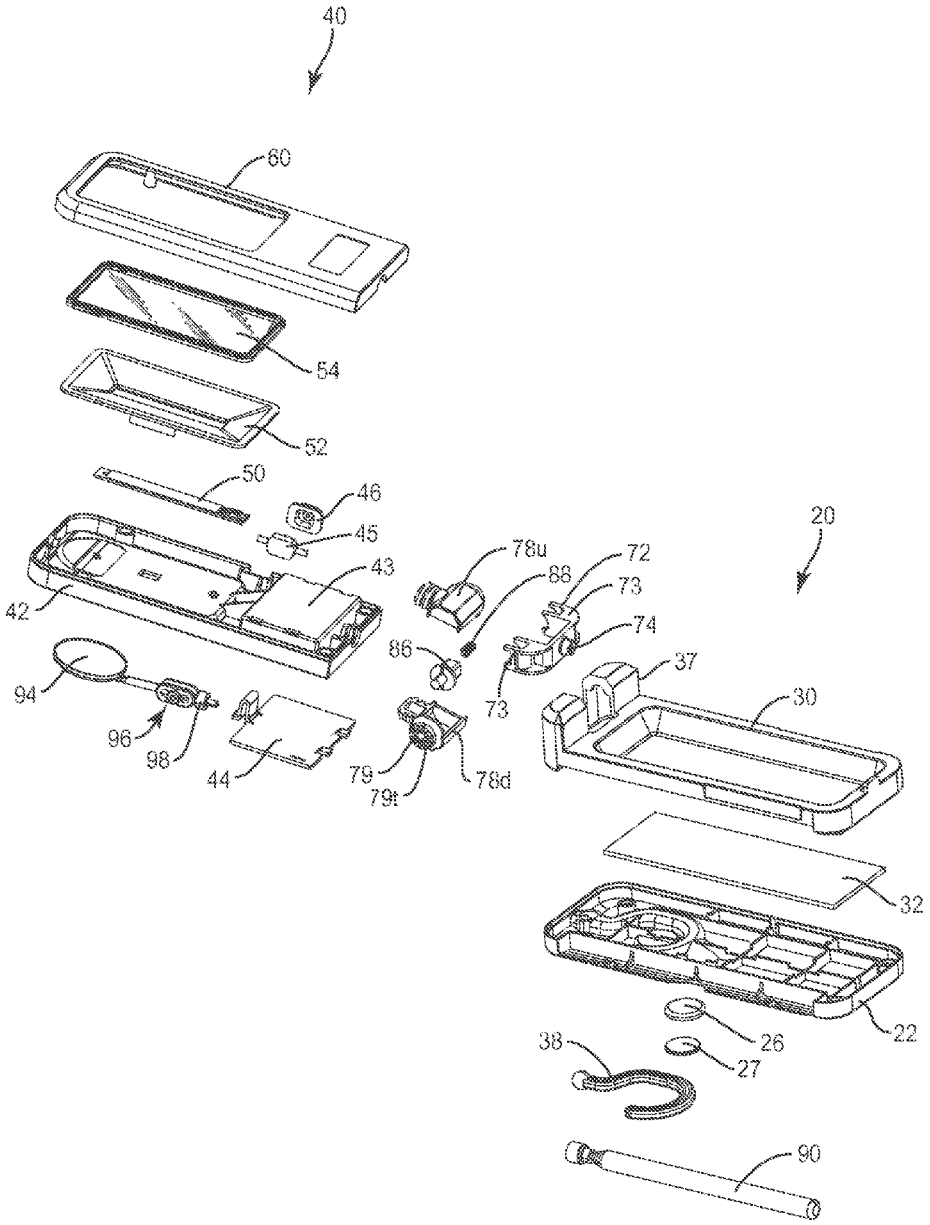
FIG. 6 shows an exploded view of the lighting device of FIG. 1.
Figure 7:
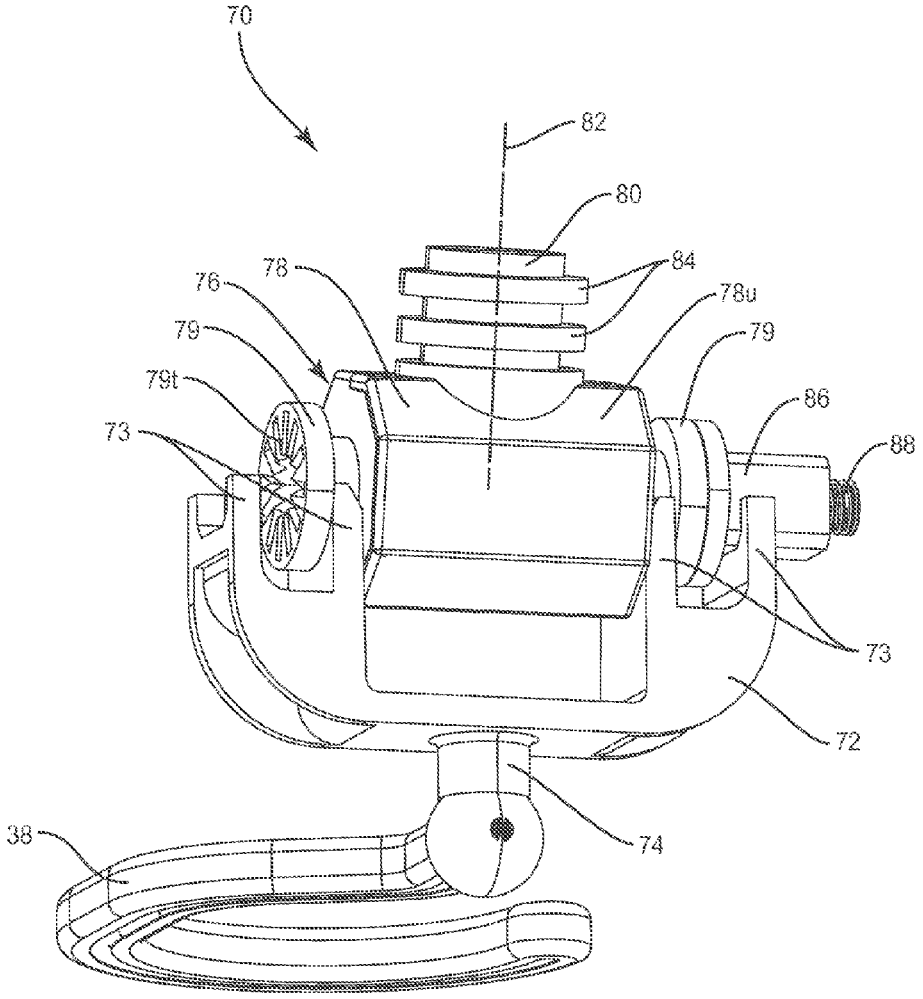
FIG. 7 shows one embodiment of a pivot mechanism.

The head section 40 includes a main frame 42, a bezel 60, and a light source 50. Similar to main frame 22 of the base section 20, the main frame 42 of the head section 40 is advantageously generally rectilinear, with suitable internal reinforcing ribs and the like, and with suitable external recesses, as discussed further below. The main frame 42 includes a battery recess 43, which is selectively enclosed by battery cover 44. In addition, as shown in FIG. 5, the main frame 42 advantageously includes a tool recess 47, advantageously with a suitable clip 48 formed therein. The bezel 60 attaches to the main frame 42 on a side thereof opposite the tool recess 47. The bezel 60 helps retain the light source 50, and provides a suitable opening for allowing light emitted by the light source 50 to shine outward in a variably oriented emission direction E. For reference, a theoretical plane P is disposed normal to emission direction E. The light source 50 is disposed internal to the head section 40. The light source 50 may take any suitable form, such as a light bulb, a simple LED, or the like, but advantageously takes the form of a Chip On Board Light Emitting Diode (COB LED) assembly. A reflector 52 may optionally be disposed around the light source 50 so as to aid in suitably directing the emitted light. In addition, an optional transparent cover 54 may be disposed between the light source 50 and the bezel 60 so as to help protect the light source 50 from debris and the like. The light source 50 may be powered by batteries (not shown) that are disposed in the battery compartment 43. The power to the light source 50 is controlled by a suitable switch assembly, which may be disposed on a lateral side of the head section 40, or elsewhere as desired. The switch assembly may take any suitable form, such as an electrical switch 45, optionally protected by a suitable switch cover 46. In some embodiments, pushing the switch assembly toggles the light on and off. Advantageously, head section 40 and base section 20 have substantially the same footprint, so that when head section 40 is fully overlapping main frame 42, the two pieces form an aligned stack.

As mentioned above, the head section 40 is movably mounted to the base section 20 by the pivot mechanism 70. The pivot mechanism 70 may take any suitable form known in the art that allows the head section 40 to pivot relative to the base section 20 about two different axes that remain mutually perpendicular. In some embodiments, the pivot mechanism 70 includes a support bracket 72, a pivot body 76, and an optional latch 86. The support bracket 72 mounts to the bezel 30 of the base section 20, substantially internal to the bosses 37. The support bracket 72 is somewhat U-shaped, with a central recess and upstanding retention flanges 73. The retention flanges 73 help rotatably support the pivot body 76. The lower side of the support bracket 72 may include a downwardly extending stub 74 for engaging a portion (typically ball-shaped) of the hook 38, if desired. The pivot body 76 includes a block 78 and a stem 80, and may be made from a unitary piece or may be made from multiple pieces. For the illustrated embodiment, the pivot body 76 is made from two pieces, for ease of reference referred to as the upper half **78*u* and the lower half 78*d* (due to their relative locations in FIG. 5). The block 78 is disposed mostly between the retention flanges 73, but includes laterally extending ears 79 that engage with the support bracket 72 to allow the pivot body 76 to rotate relative to the support bracket 72, and thus the base section 20, about fixed pivot axis F. One or both ears 79 may include suitable features, such as outboard teeth 79*t*, that help provide detent rotational positions for the block 78 when engaged by detent latch 86. The detent latch 86 includes corresponding detent features and is biased into engagement by spring 88. The stem 80 extends from the block 78 along stem axis 82 which is coincident with pivot axis M. Note that pivot axis M is movably disposed relative to fixed pivot axis F due to the rotation of pivot body 76 about pivot axis, and may thus be referred to as movable pivot axis M, The stem 80 may include one or more peripheral rings 84, as is desired. The stem 80 extends into a stem recess 49 on head section 40, formed by the main frame 42 and/or bezel 60. The interior surface of stem recess 49 advantageously includes suitable structures (e.g., corresponding rings) to slidingly mate with the rings 84 on stem 80, so that head section 40 may rotate around movable pivot axis M, advantageously a full 360°. The pivot mechanism 70 allows the head section 40 to be simultaneously pivotable relative to the base section 20** about two different axes, fixed pivot axis F and movable pivot axis M, with these two pivot axes F,M remaining mutually orthogonal throughout the pivoting motion.

The lighting device 10 optionally includes a pick-up tool 90 that may be removably received in side recess 39 of base section 20. The pick-up tool 90 may take the form of a telescoping rod with a magnetic tip 92. When not in use, the pick-up tool 90 may be stored in side recess 39.

Figure 9:
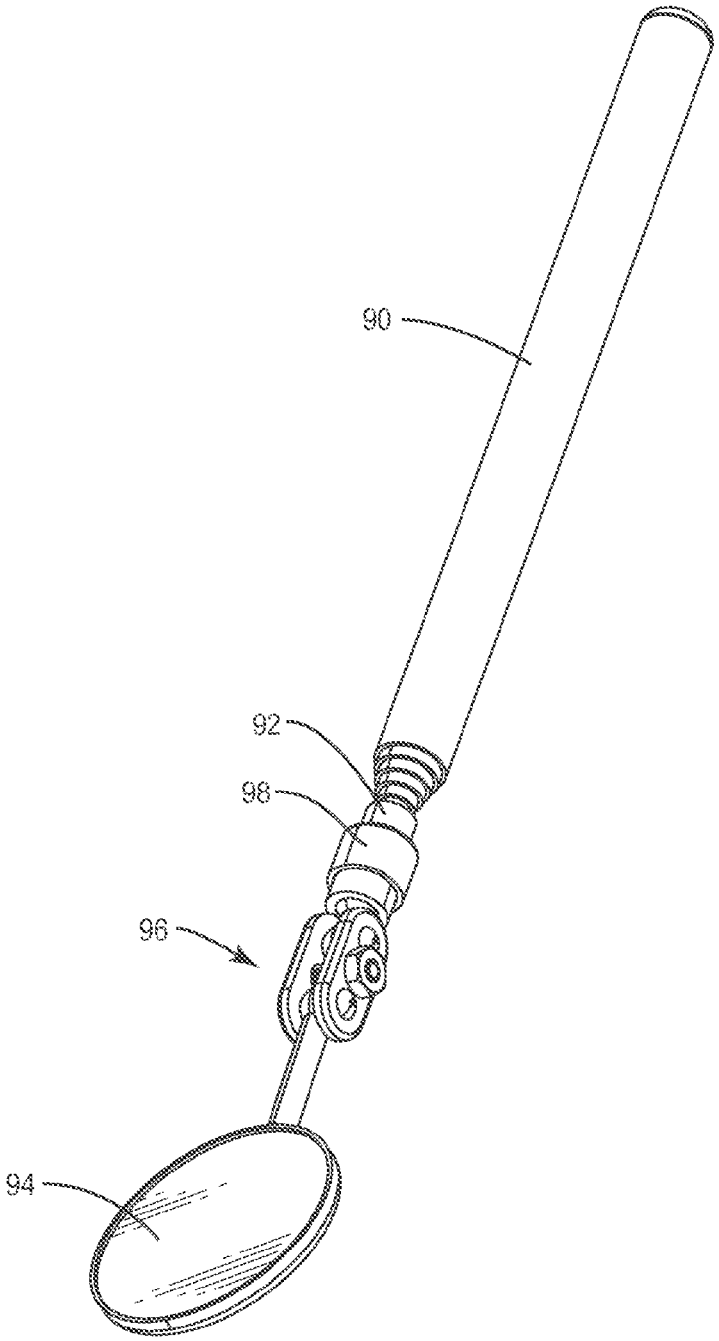
FIG. 9 shows a pick-up tool with a mirror assembly attached.

In addition, the lighting device 10 may optionally include a mirror 94 that may be removably mounted to head section 40 in tool recess 47 via clip 48. The mirror 94 may advantageously include a multi-axis joint 96, and a suitable mounting portion 98 for mating with the magnetic tip 92 of pick-up tool 90. Thus, the mirror 94 may be mated to pick-up tool 90 to provide a selectively elongated observation tool. See FIG. 9. Advantageously, the mounting portion 98 of the mirror 94 forms a male portion of a male-female connection, with the tip 92 of the pick-up tool 90 forming the complementary female portion, so that the mirror 94 is more easily stored. However, this male/female relationship may reversed, or other connections may be used. Further, the mounting portion 98 may optionally include a short pin-like structure if desired, that advantageously mates with a corresponding receiving hole in the tip 92.

The lighting device 10 may be selectively moved into a variety of configurations by moving head section 40 relative to base section 20. For example, the head section 40 may be pivoted about fixed pivot axis F from a closed configuration (FIG. 1) to an open configuration (FIG. 2), so that an angle $\alpha$ between the longitudinal axis 21 of the base section 20 and the pivot axis M (along stem 80) is variable from approximately 0° to about 180° (in side view). Because longitudinal axis 21 may not intersect movable pivot axis M, angle $\alpha$ is considered to be zero degrees when the movable pivot axis M is parallel to longitudinal axis 21, and the portions of the head section 40 and the base section 20 farthest from fixed pivot axis F are oriented in the same direction. Thus, as shown in FIG. 1, the lighting device 10 may be placed in a closed configuration, where the head section 40 is conceptually closed against the base section 20. In this closed configuration, angle $\alpha$ has a low first value, such as 0°; the theoretical plane P is parallel to fixed pivot axis F; and the entire perimeter 36 of the storage cavity 34 is fully overlapped by the head section 40 so that the storage cavity 34 is enclosed. The lighting device 10 may, from the closed configuration, be moved to a first open configuration, such as that shown in FIG. 2. In this first open configuration, the angle $\alpha$ is a larger amount than in the closed configuration, such as the illustrated about 60°; the theoretical plane P is still parallel to fixed pivot axis F; and the entire perimeter 36 of the storage cavity 34 is not fully overlapped by the head section 40 so that the storage cavity 34 is at least partially open. Note that the movement from the closed configuration to the illustrated first open configuration may involve rotation of the head section 40 relative to the base section 20 about fixed pivot axis F, with the movable pivot axis M remaining orthogonal to fixed pivot axis F. From the first open configuration of FIG. 2, the head section 40 may be rotated simultaneously about both the fixed pivot axis F and the movable pivot axis M so that the lighting device 10 assumes a second open configuration, such as that shown in FIG. 3. In the second open configuration of FIG. 3, the angle $\alpha$ is a third amount larger than the second amount, such as the illustrated about 90°; the theoretical plane P is transverse to the fixed pivot axis F; and the entire perimeter 36 of the storage cavity 34 is not overlapped by the head section 40 so that the storage cavity 34 is at least partially open. Of course, the first and second open configurations could be different than those illustrated, with more or less rotation about fixed pivot axis F and/or movable pivot axis M. Further, from the configuration shown in FIG. 3, the head section 40 could be rotated counter-clockwise about movable pivot axis M a bit more, and then the head section 40 rotated clockwise about fixed pivot axis F to close the head section 40 against the base section 20, so that the result is a different closed configuration similar to that shown in FIG. 1, but with the emission direction E being toward floor 32, rather than away from the floor 32 as shown in FIG. 1.

Figure 8:
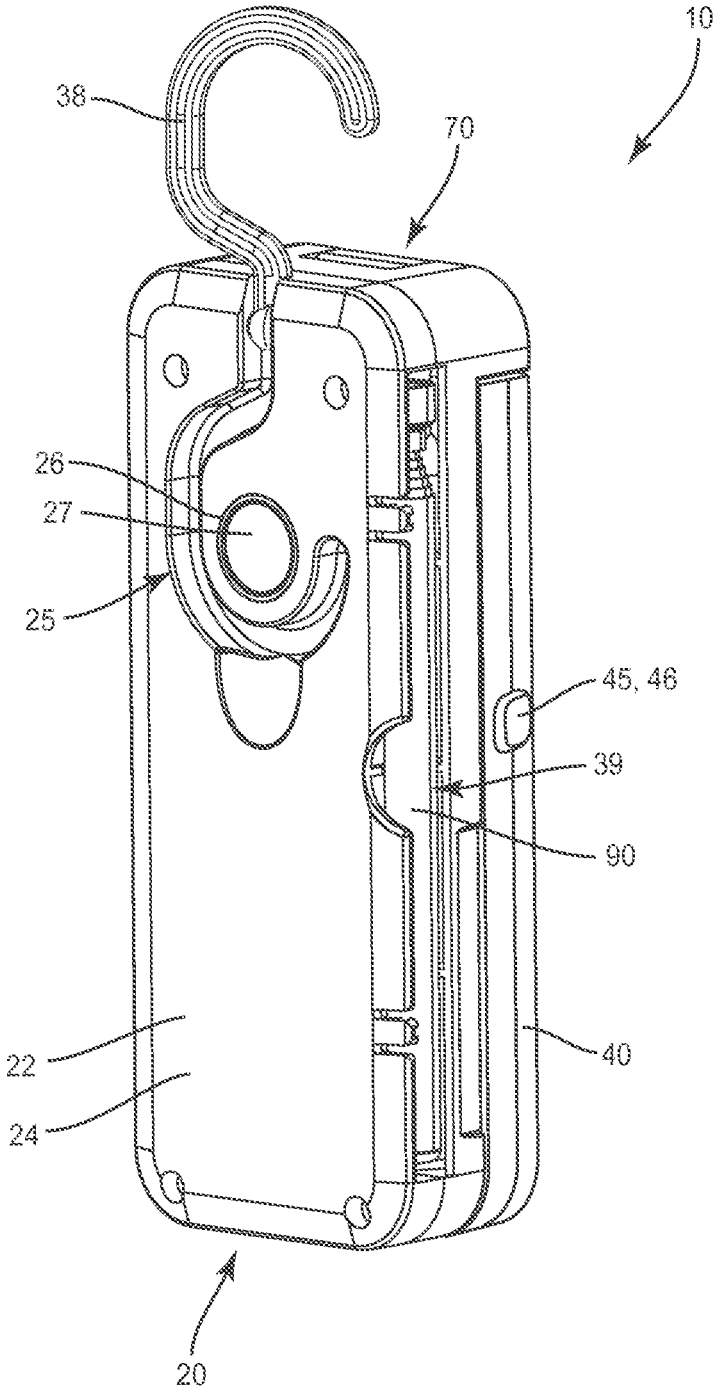
FIG. 8 shows the lighting device of FIG. 1, with the hook deployed.

Because head section 40 can be independently swiveled about both fixed pivot axis F and movable pivot axis M, either serially or simultaneously, the lighting device 10 is very versatile. The light from light source 50 (in emission direction E) can be oriented in a wide variety of directions relative to the base section 20, such as upward (upward in this context being directly away from the floor 32 of storage cavity 34), downward, laterally to either side, forwardly (forward in this context being generally in the direction from fixed pivot axis F toward the opposite end of storage cavity 34), rearwardly, and numerous directions in-between. Further, the provision of the storage cavity 34 allows small items to be securely stored, and the provision of the magnetic floor 32 helps prevent small metallic items from being lost when the storage cavity 34 is open (e.g., FIG. 3). Further, the lighting device 10 may be simply placed on a suitable surface (e.g., tabletop), or, with the hook 38 deployed (see FIG. 8), the lighting device 10 may be hung from a suitable support. Further, still, the provision of a magnet 26 with underside surface 24 of the base section 20 allows the lighting device 10 to be magnetically held against a non-horizontal surface, such as the side of a toolbox.

The lighting device 10 may be made from any suitable materials, such as plastics, metals, or combinations thereof, known in the art.

The present invention may, of course, be carried out in other specific ways than those herein set forth without departing from the scope of the invention. The present embodiments are, therefore, to be considered as illustrative and not restrictive.

What is claimed is:

1. A lighting device, comprising:

a head section pivotally connected to a base section via a connection assembly;

the base section having a longitudinal axis and comprising:

a storage cavity having a generally planar floor, wherein the floor is magnetic;

an upper surface defining a perimeter about the storage cavity; wherein the perimeter surrounds the storage cavity so as to peripherally enclose the storage cavity when viewed normal to the floor;

the head section comprising:

a base frame;

a cover attached to the base frame;

a light source disposed so as to selectively emit light beyond the cover in an emission direction E oriented from the base frame toward the cover;

a telescoping shaft removably mounted to the base section; the telescoping shaft having a magnetic tip;

a mirror assembly removably mounted to the head section;

wherein the mirror assembly is configured to be removably mated to the telescoping shaft via the magnetic tip;

wherein the connection assembly comprises a pivoting body pivotably mounted to the base section and pivotably mounted to the head section;

wherein the connection assembly is configured to allow the head section to simultaneously pivot relative to the base section both:

about a fixed first axis disposed transverse to the longitudinal axis of the base section; and about a movable second axis that remains disposed orthogonal to the first axis;

wherein the fixed first axis is disposed in spaced relation to the storage cavity so as to be offset from the storage cavity;

wherein the lighting device is movable between a first closed configuration, a first open configuration, and a second open configuration;

wherein, in the first closed configuration:

an angle $\alpha$ between the second axis and the longitudinal axis of the base section is a first amount;

a first theoretical plane normal to the direction E is parallel to the first axis;

the entire perimeter of the storage cavity is overlapped by the head section so as to enclose the storage cavity;

wherein, in the first open configuration:

the angle $\alpha$ is a second amount more than the first amount;

the first theoretical plane is parallel to the first axis;

less than the entire perimeter of the storage cavity is overlapped by the head section so that the storage cavity is at least partially open;

wherein, in the second open configuration:

the angle $\alpha$ is a third amount larger than the second amount;

the first theoretical plane is transverse to the first axis;

less than the entire perimeter of the storage cavity is overlapped by the head section so that the storage cavity is at least partially open.

2. The lighting device of claim 1, wherein the head section is rotatable 360° about the second axis.

3. The lighting device of claim 1, wherein the angle $\alpha$ may vary between about 0° and about 180°.

4. The lighting device of claim 1, wherein the base section further comprises a selectively deployable hook.

5. The lighting device of claim 1:

wherein the base section comprises a recess, the recess disposed in spaced relation to the storage cavity and generally parallel to the longitudinal axis of the base section;

wherein the recess is configured to receive the telescoping shaft.

6. The lighting device of claim 1, wherein the mirror assembly is removably mated to the telescoping shaft via a male/female connection that includes the magnetic tip, with the mirror assembly being a male portion of the male/female connection.

7. The lighting device of claim 1, wherein the head section comprises a movable switch operative to control an on/off state of the light source; wherein the movable switch is disposed on a lateral side of the head section.

8. The lighting device of claim 1, wherein the connection assembly includes a plurality of detents configured to hold the head section in a plurality of positions relative to the base section.

9. The lighting device of claim 1, wherein the light source comprises a Chip On Board Light Emitting Diode (COB LED) assembly.

10. The lighting device of claim 1, wherein the first amount is 0°, such that the second axis is parallel to the longitudinal axis of the base section.

11. The lighting device of claim 3:

wherein the lighting device is movable between the first closed configuration, the first open configuration, the second open configuration, and a third open configuration;

wherein, in the third open configuration:

the angle $\alpha$ is about 180°;

the first theoretical plane is parallel to the first axis and parallel to the floor;

the entire perimeter of the storage cavity is not overlapped by the head section so that the storage cavity is fully open.

12. The lighting device of claim 1:

wherein the head section comprises a battery compartment for housing batteries to power the light source;

wherein the battery compartment is fixed relative to the light source, and not moveable relative thereto.

13. The lighting device of claim 1, wherein, in the first closed configuration, direction E is directly away from, and perpendicular to, the floor.

* * * * *